US007223152B2

(12) United States Patent
Anderson

(10) Patent No.: US 7,223,152 B2
(45) Date of Patent: May 29, 2007

(54) WIND PROPELLED ROLLING TOY

(76) Inventor: John H. Anderson, 214 Goldenrod Ave., Corona del Mar, CA (US) 92625

( * ) Notice: Subject to any disclaimer, the term of this patent is extended or adjusted under 35 U.S.C. 154(b) by 183 days.

(21) Appl. No.: 10/928,075

(22) Filed: Aug. 27, 2004

(65) Prior Publication Data

US 2005/0142981 A1 Jun. 30, 2005

Related U.S. Application Data

(60) Provisional application No. 60/498,397, filed on Aug. 27, 2003.

(51) Int. Cl.

| | |
|---|---|
| ***A63H 33/00*** | (2006.01) |
| ***A63H 17/00*** | (2006.01) |
| ***A63H 29/10*** | (2006.01) |
| ***A63H 33/40*** | (2006.01) |

(52) U.S. Cl. ..... 446/487; 446/488; 446/93; 446/94; 446/176

(58) Field of Classification Search ..... 446/487, 446/488, 93, 94, 95, 387, 388, 176
See application file for complete search history.

(56) References Cited

U.S. PATENT DOCUMENTS

| | | | | |
|---|---|---|---|---|
| 537,735 | A * | 4/1895 | Trufant | 446/488 |
| 604,180 | A | 5/1898 | Todd | |
| 1,111,216 | A * | 9/1914 | Church | 446/88 |
| 1,370,303 | A * | 3/1921 | Gillespie | 446/99 |
| 1,443,271 | A | 2/1923 | Nefedov | |
| 1,496,564 | A * | 6/1924 | Thompson | 446/94 |
| 2,351,542 | A | 6/1944 | Paull | |
| 2,377,572 | A * | 6/1945 | Pedersen | 446/97 |
| 3,355,837 | A * | 12/1967 | Pedersen | 446/94 |
| 3,572,740 | A | 3/1971 | Rypinski | 280/16 |
| 3,798,830 | A * | 3/1974 | Grieder | 446/158 |
| 4,049,287 | A | 9/1977 | Dudouyt | 280/213 |
| 4,117,900 | A | 10/1978 | Amick | 180/7 |
| 4,332,395 | A | 6/1982 | Zech | 280/213 |
| 4,408,772 | A | 10/1983 | Hollworth | 280/1 |
| 4,426,806 | A | 1/1984 | Woodworth | 46/248 |
| 4,807,802 | A * | 2/1989 | Williams | 220/4.28 |
| 4,886,478 | A | 12/1989 | Jones | 446/176 |
| 5,326,301 | A | 7/1994 | Woodside | 446/176 |
| 6,475,060 | B1 * | 11/2002 | Liu | 446/487 |

* cited by examiner

*Primary Examiner*—Eugene Kim
*Assistant Examiner*—Urszula M Cegielnik
(74) *Attorney, Agent, or Firm*—Cislo &Thomas LLP; Daniel M. Cislo, Esq.; Kelly W. Cunningham, Esq.

(57) ABSTRACT

Provided may be a wind propelled rolling vehicle with a self-adjusting sail that may be substantially formed in a relatively small, single sheet of material, or assembled onto a standard chassis. The exemplary embodiments may utilize bushings to spread dynamic loads so as to allow the use of very light structural material such as thin sheet foam thereby forming a safe, low-mass toy vehicle capable of achieving good acceleration and rolling speed relative to a given wind force, and configurable into many themes.

15 Claims, 6 Drawing Sheets

WIND PROPELLED ROLLING TOY

CROSS-REFERENCE TO RELATED APPLICATIONS

This application claims the benefit of U.S. Provisional Patent Application No. 60/498,397, filed on Aug. 27, 2003, which is hereby incorporated by reference in its entirety for all purposes.

BACKGROUND

Wind driven toys are quite popular. For instance, some wind driven toys may include kites, toy sailboats, and pinwheels, among others. Toys for use in the outdoors are very popular and are probably increasing in popularity with the recent increase of people enjoying outdoor activity. Quite often, even the slightest breeze will bring out a number of kite fliers flying everything from the simplest kite to very elaborate stunt kites. Additionally, pinwheels, whirligigs, and other such wind driven toys can be amusing to watch on breezy days.

Although these wind-actuated toys are well known and widely used, they may suffer from a serious drawback. Some wind driven toys are static, in that the user of a kite or toy sailboat, for example, uses these devices while remaining substantially stationary. Such devices are incompatible with the desire to enjoy a breezy day while exercising. This drawback of these toys is especially noticeable given the emphasis on activity and exercise prevalent in society today. It is quite well known that a sedentary lifestyle and maintaining a healthy body may be mutually exclusive ideas. Therefore, it may be advantageous to have an action toy that would allow people to have fun on a windy day as kites and other such devices allow, while also providing the opportunity for enjoying an aerobic workout. Such an action toy could also encourage people to abandon indoor, sedentary habits and activities, such as video games, watching television, surfing the Internet, and the like, among others.

A drawback of many other popular action toys may be that they require a power source of some sort, whether batteries or otherwise. Advantageously, with the increased emphasis on environmental friendliness in all aspects of peoples' lives, a decrease in power consumption and/or disposable battery consumption would be enjoyed by all. Therefore, it would be desirable to have an action toy not requiring an outside, polluting power source.

Furthermore, flying discs and the like may be limited in the distance they travel by their design and by the amount of force that can be applied by a user. Therefore, it would be advantageous to have a toy that would travel relative long distances with little or no force imparted to it by a user. Yet further, it would be advantageous to have an inexpensive toy that can be easily replaced if broken.

SUMMARY

Provided is a wind propelled rolling toy that may be formed in a relatively small, single sheet of material, and that may be easily assembled and used by a user. The device may include a body portion coupled to a sail portion wherein the sail portion is configured to utilize wind as a propulsion source, along with a self-adjusting device or configuration that may continuously optimize the sail angle relative to the direction of wind and the direction of travel of the device. Other exemplary embodiments may include a standardized frame portion that mat be configured to accommodate a wide variety of portions and accessories. Furthermore the system may be capable of many configurations and themes.

DETAILED DESCRIPTION

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of this disclosure.

Exemplary embodiments disclosed herein may include a simple, wind-driven, generally non-mechanized action toy vehicle that does not require batteries or other power sources. The methods and systems disclosed herein may also provide an amusing play action wherein the user can actively walk or run along with the system and enjoy active exercise. The user and observers may enjoy its rolling travel and animated sail action, such as a rider assuming various reactive postures, and graphic effects. In addition to the animated action of the sail adjusting to the wind, various parts can be further animated. For example, the entire sail can be sprung, sail/body segments can be jointed and sprung, and the entire vehicle can be animated using, for example, eccentric wheels. The play action and value may also be enhanced by the graphics and configuration of the system in the forms of a skateboarder, roller skater, racing vehicle, surfer, and the like. Furthermore, the manufacturing and packaging methods may reduce costs sufficiently to allow the system to be offered for a relatively low price, or given away as a promotional item.

Figure 1:
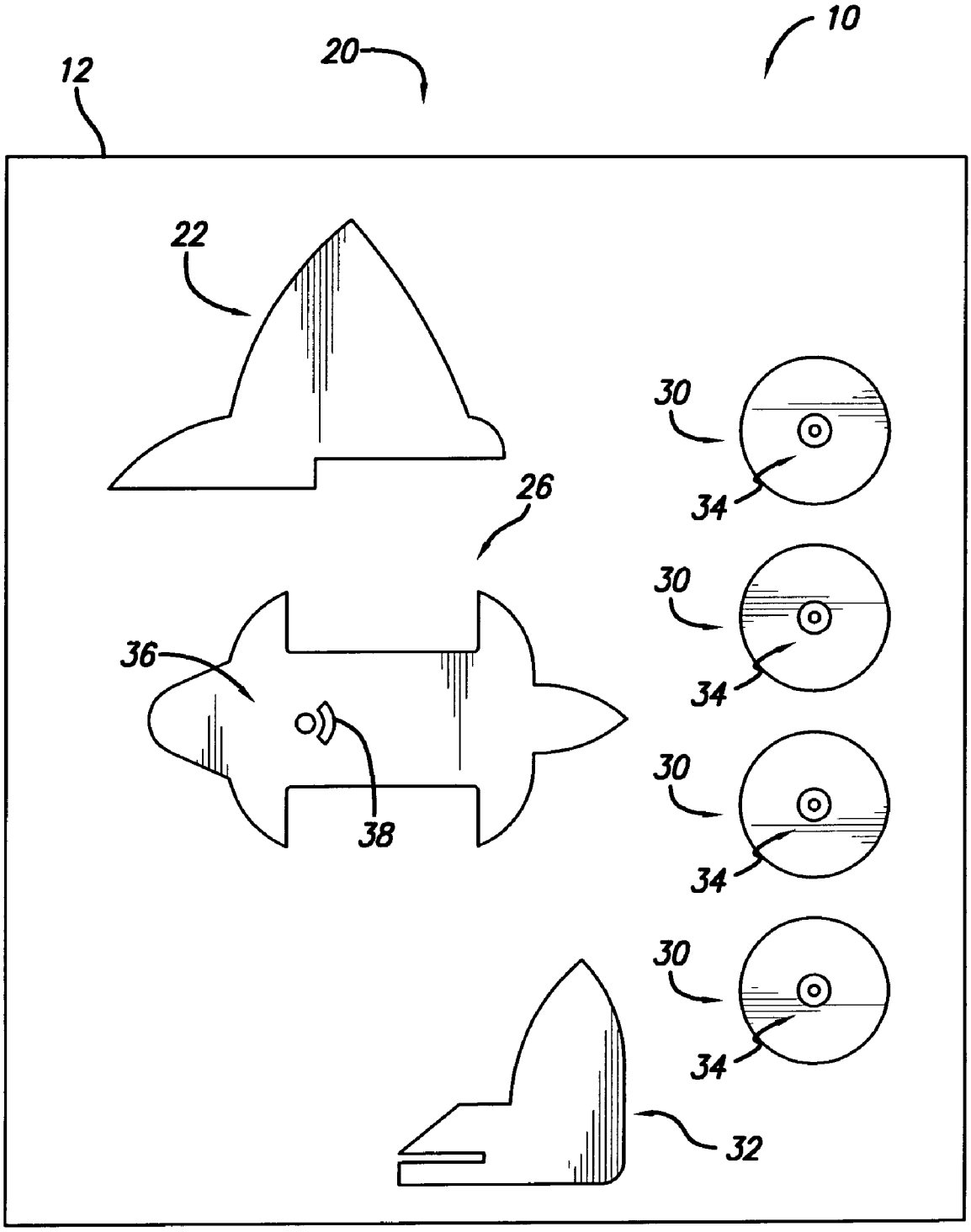
FIG. 1 is an exemplary embodiment of a vehicle system according to the present invention.

A vehicle system according to an exemplary embodiment is shown in FIG. 1, generally at 10. System 10 may include a sheet 12 as well as coupling components 14 (not shown in this figure). Sheet 12 may include removable portions 20. Removable portions 20 may include a first shape 22, a second shape 26, a third shape 30, and a fourth shape 32. In this embodiment, the first shape 22 may be in the form of a sail, while second shape 26 may be in the shape of a body portion. Third shape 30 may be in the form of a wheel in this embodiment, and fourth shape 32 may be in the form of a fin or tail in this embodiment. As shown, shapes may be removable from sheet 12 and may include graphics and/or other configurations such that they may be easily assembled into a three dimensional vehicle.

In this embodiment, components 14 (not shown) may include an axle, a sail coupling adapter, as well as other adapters and piece parts that may facilitate coupling the shapes together to form a three dimensional vehicle. Alternatively an axle may be configured with the body portion, as desired. Sheet 12 may be made from a material such as expanded polystyrene, polyethylene, relatively thin cardboard, nerf-type foam material, or other generally lightweight, durable, and inexpensive material, but may be made from other materials, as desired. The shapes may be die cut or "kiss-cut" where the resultant sheet may be packaged and sold intact. Furthermore, they may be die cut to easily be removed from sheet 12 by a user, such as a child. However, some parts may be removed from the sheet during manufacturing, and placed within the package so as not to require them to be punched out by the user prior to assembly.

Wheel 30 may include a bushing 34 which may facilitate the wheels rotating about an axle more easily to allow the system 10 to roll with little force acting upon it, such as a slight breeze, among others. Furthermore the bushings 34 may spread the dynamic load of the system to allow the use of low mass material, otherwise not structurally suitable, for the wheels. With this configuration a vehicle system may be produced inexpensively and may be easily put together by a child and used as a toy. This type of system may be very inexpensive to manufacture and distribute, such that the price may be relatively low, which may make user's more likely to purchase multiple systems, or advertisers to give them away.

Body portion 26 may include an orifice 36 and a slot 38. Orifice 36 may be configured to allow a sail coupling adapter to fit therethrough. Furthermore, a bushing may be included in orifice 36 to facilitate the movement of components, as well as add to the durability and longevity of the system. Furthermore the bushings may spread the dynamic load of the system to allow the use of low mass material for other portions of the system. This bushing may have the same configuration as bushing 34 to further reduce manufacturing costs.

Slot 38 may be configured to allow a portion of the coupler acting as a stop, to rotate within the angular limits of slot 38, such that the sail may be limited in travel, such that it may move with the wind to utilize wind forces to move the entire system. Furthermore this configuration may provide a self-adjusting sail configuration that may adjust to the wind to allow the system to travel a longer distance.

It will be appreciated that the sail may have many orientations with respect to the body portion, i.e. facing generally parallel, perpendicular, etc. with respect to the body portion. Furthermore, the sail may be located in many positions adjacent the body. More than one sail may be utilized with one body portion.

System 10 may also further include other accessories, which may couple to various portions of the vehicle and/or system to enhance the appearance and may also enhance the play value of the system. These other accessories may also include noisemakers, lighting effects, stickers, graphics, and the like, which may be included in the system package, but not necessarily formed in sheet 12.

The systems disclosed herein are designed to depict a broad range of themes. It will be appreciated that various components of the system may be utilized with other systems, making the system highly configurable. The use of light-weight material may also provide safety and crash resistance, relatively fast acceleration, and low overall cost of construction and shipping, among others.

Figure 2:
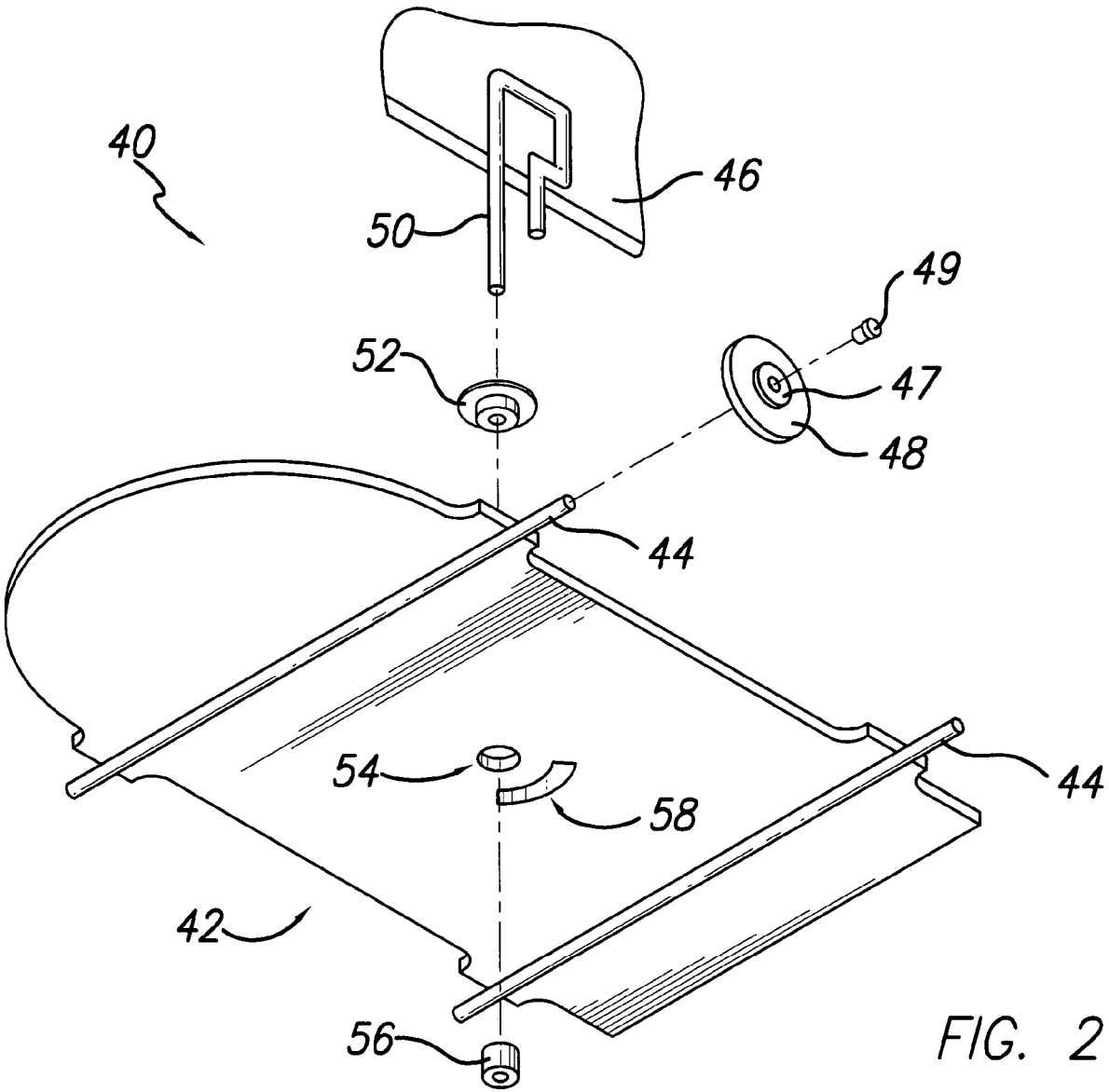
FIG. 2 is an exploded, elevational view of an exemplary embodiment of a vehicle system.

FIG. 2 may show another exemplary embodiment of a system, generally at 40. System 40 may include a body portion 42 as well as one or more axle portions 44 coupled thereto. Axle portions 44 may be coupled to body portion 42 in many different ways including gluing, adhesives, friction fit, interference fit, or other configurations and methods of coupling axle 44 to body portion 42, as desired.

Axles 44 may be telescoping or of varying widths to receive many different types, widths, etc. of wheels and bodies. This may include wider wheels, which may give the system a customized appearance. Furthermore a wider or longer axle configuration may aid the performance of the system in higher wind conditions.

System 40 may also include a sail portion 46 which may be configured to rotatably couple to body portion 42, generally at the top of body portion 42, via sail or mast stop adapter 50 and sail bushing 52. Sail bushing 52 may be configured to fit through orifice 54 and couple to retainer 56 to allow adapter 50 and sail portion 46 to be rotatably coupled to body portion 42. Adapter 50 may include a portion that may extend through slot 58 within body portion 42 such that the sail 46 and adapter 50 may be limited in travel such that once the vehicle is moving, the sail may automatically adjust to utilize the forces of a breeze or wind to continue moving. Furthermore, adaptor 50 may couple to sail 46 and to body portion 42 to allow for continuous, self-adjusting, optimization of the sail position relative to the wind direction and vehicle travel direction. It will be appreciated that sail portions, and/or other portions of the various embodiments may be expandable and generally 3-dimensional.

System 40 may further include one or more wheel portions 48 which may rotatably couple to axle 44 near the ends of axle 44, and may be secured to axle 44 via hub 49. Furthermore, wheel 48 may include a bushing 47 which may be made of a hard plastic or other material such that it would more freely rotate about axle 44. As discussed in the previous embodiment, the coupling components/accessories included with the system may include the adapter 50, sail bushing 52, connector 56 and hub 49, among others. In this manner, small piece parts may be included in the system separately from the sheet and/or preassembled onto their respective positions on the portions of the sheet. The user may assemble the preassembled subassemblies before use. The retainers, hubs, etc. may be precoupled to the system and the user may remove them and recouple them after assembling the system.

Wheels in the various systems may be transparent or semi-transparent, which may make the system appear as if it is floating. Furthermore the wheels may be located under the body portion, such that the wheel may not be easily seen.

In this embodiment body portion 42 may come with axles 44 already attached or coupled thereto, however there may be an adhesive strip or other configuration for coupling axle 44 to body portion 42.

In an exemplary embodiment, sail bushing 52 may be made from a plastic material and may be pre-affixed to the sail and/or body 42 prior to shipment, as desired. Adaptor 50 may be configured to extend through, and ride on, sail bushing 52 in the body such that the sail may be capable of lateral movement to better translate wind forces onto vehicle motion, depending upon the direction of the wind and the direction of the travel of the vehicle.

With this configuration, a relatively small, lightweight, inexpensive, easy to assemble child's toy may be made such that a user, such as a child, will be able to construct and use the vehicle relatively easily. The relatively small package, as a wrapped/backed single sheet or as a box or such containing other parts, may make it very easy to ship numerous amounts of the article of the system such that it will not take up a lot of space in packaging, shipping, storage, and display, thus making the system more attractive to retailers and users. The inexpensive nature of the system may make the system attractive to buyers as it may be easily replaced if broken, or many systems with the same or different graphics and designs may be purchased for or by a child. Therefore, these systems may configured and manufactured in a variety of sizes, including sized and used as trading cards, and the like. Furthermore, many themes may be utilized that may appeal to potential purchasers as a trading-card type product.

The system may be configured to allow the vehicle system to change directions, and/or to travel in one direction when the direction and velocity of the wind changes. Other accessories may be utilized, such as ballasts or other accessories, to enhance the characteristics of the vehicle and to enhance play value of the overall system.

In an exemplary embodiment, the slot 58 may be configured to receive the adaptor 50. It may be located along the centerline of the length of the body, and may be configured in a location where it can best convert the wind force from the sail into movement of the vehicle, without causing the vehicle to become unstable or to overturn. In an exemplary embodiment, the slot 58 may function to contain and permit free rotational movement of the adaptor 50 within the slot limits.

Further aspects of the exemplary embodiments may include that the overall geometry and continuously self-adjusting sail configuration may automatically enable the vehicle to track the wind forces to allow the vehicle to move about. Another aspect of the exemplary embodiments may be that the resultant low weight and low mass design may limit damage to the system in the event of a crash. This aspect may also allow rapid animated acceleration and desirable speeds in response to mild wind forces and wind changes.

Figure 3:
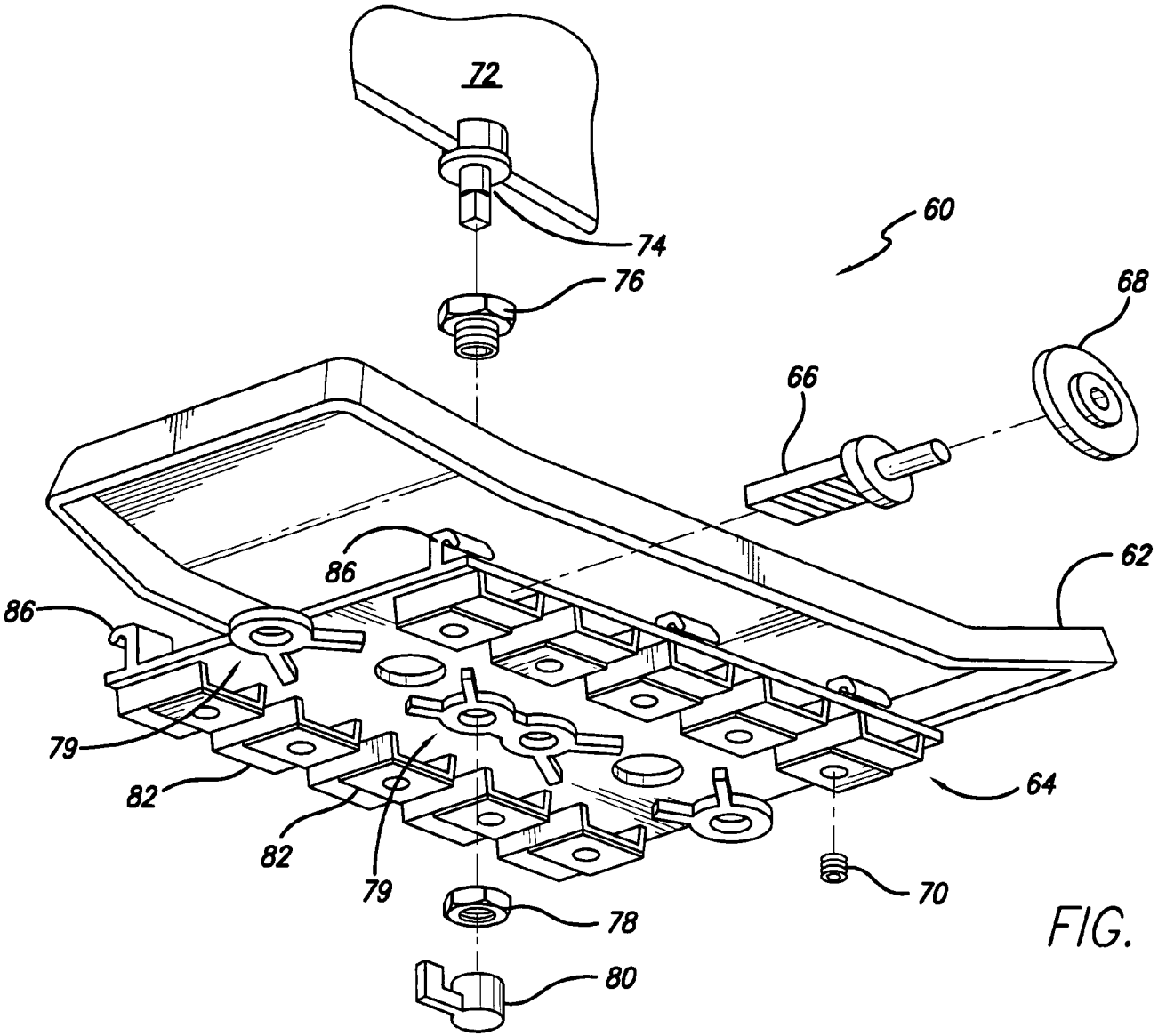
FIG. 3 is an exploded, elevational view of an exemplary embodiment of a vehicle system.

FIG. 3 shows another exemplary embodiment of a toy vehicle system, generally at 60. System 60 may include a body portion 62 as well as a frame 64, which may be configured to removably couple to body portion 62 via securing structures 86. It will be appreciated that although a generally flat body portion 62 is shown, many different three-dimensional configurations may be utilized with this embodiment for many different types, styles, and configurations of vehicles.

System 60 may further include a wheel adapter 66 which may be configured to couple to wheel receivers 82. With this configuration, the system may be highly configurable to allow a user to place wheel portions 68 and wheel adapter 66 in many different positions with respect to the frame 64, as well as having multiple wheels on the vehicle, if desired. Furthermore, although five wheel receivers 82 are shown on each side of frame 64, it will be appreciated that many other numbers and configurations may be utilized without straying from the concepts disclosed herein.

This exemplary embodiment may include a dimensionally standardized chassis and universal configuration designed to accommodate a wide variety of vehicle configurations by allowing for alternate positions for axles, sail pivot points, plug in accessories, such as ballast, etc.

System 60 may further include wheels 68 which may be configured to rotatably couple to wheel adapter 66. This configuration will allow the system to move along a support surface with a reduced amount of force, such as, but not limited to, a breeze. System 60 may further include a coupler 70 which may be configured to removably couple wheel adapter 66 to frame 64.

System 60 may yet further include a sail portion 72 as well as a sail support 74 and coupling configuration 76 and mating structure 78. With this configuration, sail support 74 may extend through coupling configuration 76. Coupling configuration 76 may be configured to extend into an orifice 79 to rotatably couple sail portion 72 to frame 64.

System 60 may further include a sail stop 80 which may couple to coupling configuration 76 and/or sail support 74, may be configured to limit the rotation of sail portion 72 with respect to frame 64. As shown, there is more than one orifice included in frame 64 such that the sail may be coupled to the system at various points with respect to frame 64. Furthermore, more than one sail may be coupled to the system, as desired.

It will be appreciated that although an exemplary embodiment for frame 64 is shown, many other configurations for a frame may be utilized. Other configurations may include, but are not limited to, a generally I-shaped configuration, a box-like configuration, a "criss-cross"-type configuration, and/or a configuration with a generally central backbone and multiple cross beams, and the like. These alternate configurations may be utilized with none, some, or all of the portions disclosed herein, as desired, without straying from the concepts disclosed herein.

Axles may be made from the expanded polystyrene, a generally hard plastic, or polyethylene material, and/or other materials and combinations thereof, as desired. In other exemplary embodiments the axles may be made of another material such as, but not limited to, wooden dowels, hard plastic, solid or tubular metal, and/or combinations thereof, and the like, and may be included in the configuration of the body portion, or shipped separately from the sheet, but in the same package, as desired.

It will be appreciated with this highly configurable system, many different configurations may be utilized which may make it more attractive to a purchaser, such as a child. Furthermore, the portions may be interchangeable such that many different portions may be used with different systems to make the system even more configurable. Furthermore, with the removable coupling configuration of body portion 62 with respect to frame 64 many different styles of body portions may be utilized with this highly configurable system.

Figure 4A:
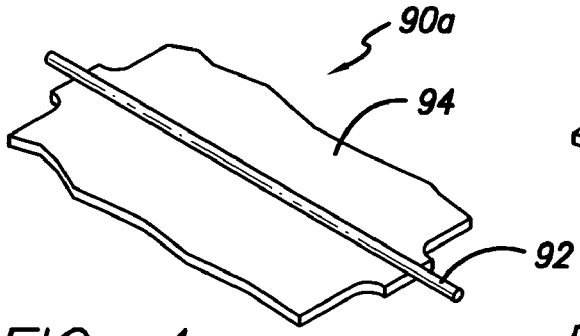
FIGS. 4*a–d* are perspective views of exemplary embodiments of axle systems.

FIG. 4*a* shows a wheel securing configuration and/or axle means according to an exemplary embodiment, generally at 90*a*. Configuration 90*a* may include an axle 92 and a body 94 such that axle 92 may be coupled to body 94 as described above with an adhesive strip, as well as other securing configurations and methods, and also may come from the factory already secured to body portion 94.

Figure 4B:
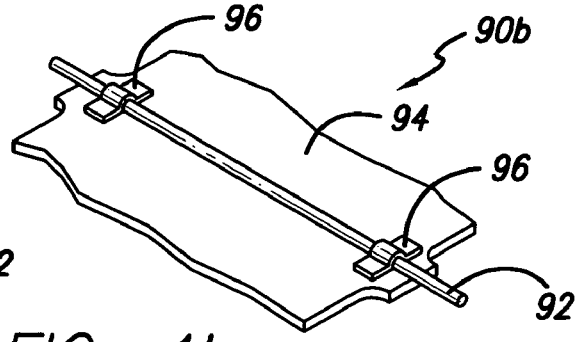

FIG. 4*b* shows a wheel securing configuration and/or axle means according to another exemplary embodiment generally at 90*b*. Configuration 90*b* includes an axle 92 and a body 94 as in the embodiment in FIG. 4*a*, as well as a coupling configuration 96 which may be configured to couple axle 92 to body 94. This configuration may also come pre-made from the factory, and/or may be easily accomplished by a user, if desired.

Figure 4C:
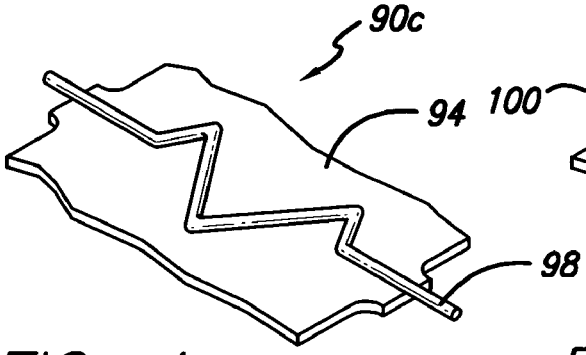

FIG. 4*c* shows a wheel securing configuration and/or axle means of another exemplary embodiment, generally at 90*c*. Configuration 90*c* includes a body portion 94 and an axle 98 coupled thereto. In this configuration, axle 98 has a generally zigzag configuration which may improve the stability of the system as well as add to the aesthetics, among other considerations. Axle 98 may again be coupled to body 94 via an adhesive or other configurations or methods, or may come from the factory to the user already coupled.

Figure 4D:
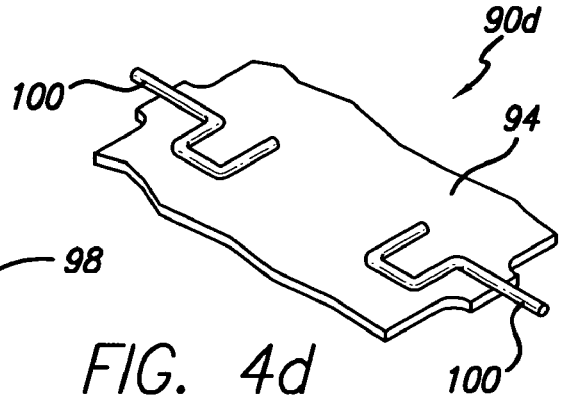

FIG. 4*d* shows another wheel securing configuration and/or axle means according to another exemplary embodiment, generally at 90*d*. Configuration 90*d* may include a body portion 94 as well as one or more axles 100. With this configuration axles 100 may not extend entirely across body portion 94 which may save money and/or reduce packaging size among other considerations. Furthermore, again axles 100 may be couplable to body portion 94 in various locations, by the user, or may come from the factory with this configuration. Body portion 94 is typically made of a styrofoam-type or polystyrene material, but may be made from balsa wood, woods, plastics, and/or combinations thereof, without straying from the concepts disclosed herein. Furthermore, in FIGS. 4*a*–4*d*, axle portions may be made of a metal, plastic, wood, polymers, and/or combinations thereof, as desired, without straying from the concepts disclosed herein.

Figure 5A:
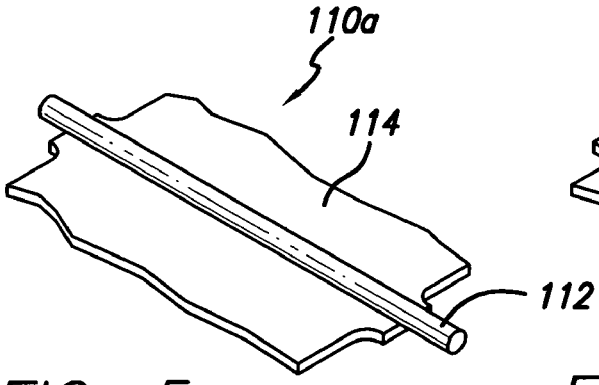
FIGS. 5*a–d* are perspective views of exemplary embodiments of axle systems.

FIG. 5*a* shows a wheel coupling configuration and/or axle means according to an exemplary embodiment, generally at 110*a*. Configuration 110*a* may include an axle portion 112 as well as a body portion 114. In this configuration, axle may be made of a wood material and may be coupled to body portion 114 via an adhesive, or other configuration or method. Furthermore the axle 112 may be coupled to body portion 114 via an adhesive or other configuration and may be configured to be coupled by a user, or may come already assembled. With this configuration axle 112 may be made of wood and may be very inexpensive. Furthermore, the system may be highly configurable and inexpensive.

Figure 5B:
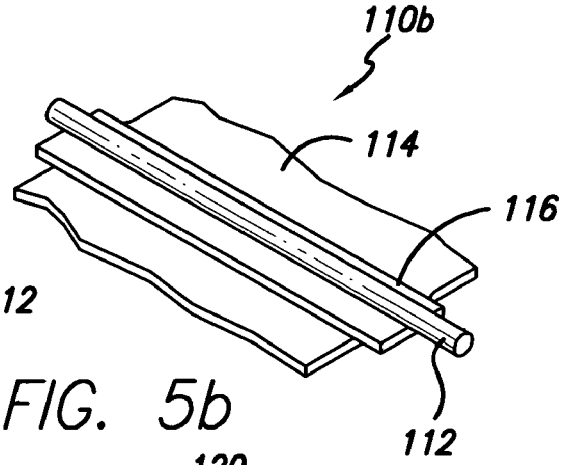

FIG. 5*b* shows another exemplary embodiment of a wheel coupling and/or axle means configuration, generally at 110*b*. Configuration 110*b* may include an axle 112 and a body portion 114 as well as an adapter 116. Adapter 116 may couple to body portion 114 as well as axle portion 112. This may add stability to the system and may also add rigidity to the system. Furthermore, this may allow for a alternate configuration as to the spacing of wheels with respect to body portion 114.

Figure 5C:
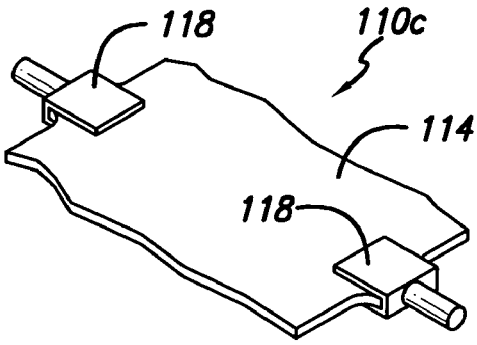

FIG. 5*c* shows another exemplary embodiment of a wheel coupling and/or axle means configuration, generally at 110*c*. Configuration 110*c* may include a body portion 114 as well as wheel couplers 118 coupled thereto. With this configuration, wheel couplers 118 may be small injection molded parts, which may be included with the system easily and inexpensively. Again, wheel coupler 118 may come from the factory already fixed to body portion 114, or may be fixed by the user, or may be removably fixed, as desired.

Figure 5D:
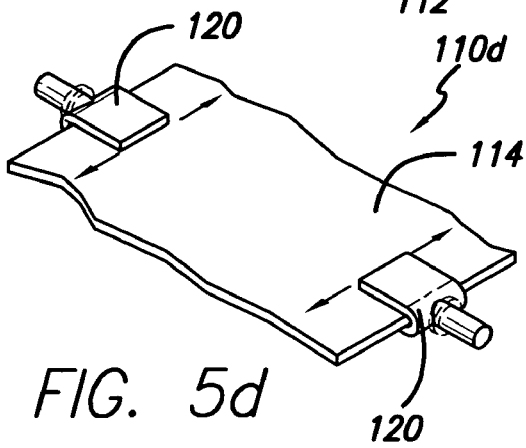

FIG. 5*d* shows a wheel coupling configuration and/or axle means according to another exemplary embodiment, generally at 10*d*. Configuration 110*d* may include a body portion 114 as well as adjustable wheel couplers 120. As shown, adjustable wheel couplers 120 may be moveable and selectively postionable with respect to body portion 114. This may make the system highly configurable and may make it more attractive to a potential purchaser such as a child. This again makes the system very highly configurable and highly adjustable, as desired.

In FIGS. 5*a* and 5*b* axle 112 may be made of wood, plastic, or other material and/or combinations thereof. In FIGS. 5*c* and 5*d*, wheel coupler 118 and adjustable wheel coupler 120 may be made of plastic, metal, wood, polymers and/or combinations thereof, as desired.

Figure 6:
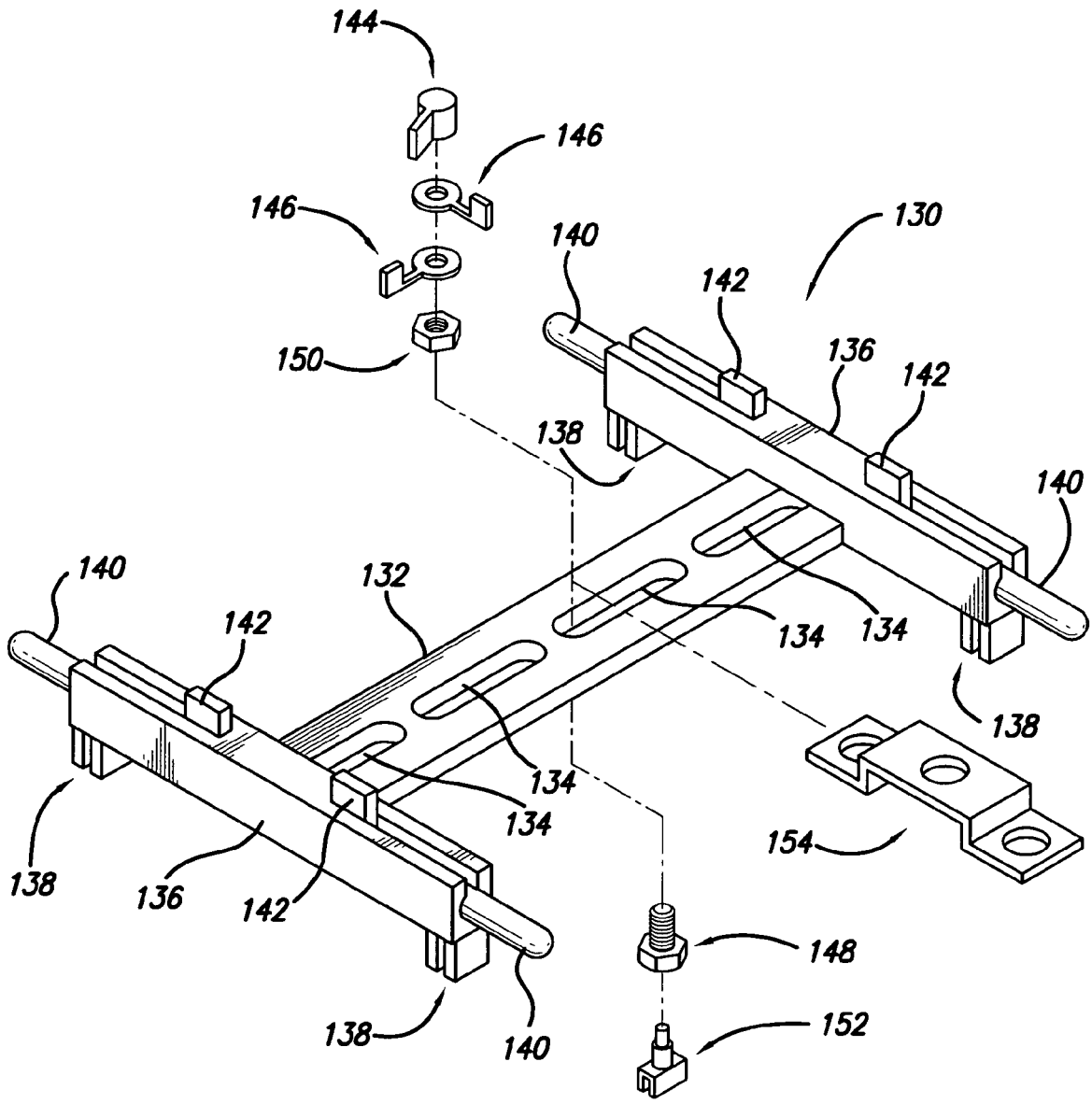
FIG. 6 is a perspective view from the underside of an exemplary embodiment of a vehicle system.

FIG. 6 shows a perspective view from the underside of a system 130 according to an exemplary embodiment of a wind powered vehicle. System 130 may include a frame 132 as well as axle portions 136. Axle portions 136 may couple to frame 132 via a friction and/or interference fit, as well as other methods and configurations, as desired. Frame 132 may include orifices 134 which may allow other portions of the system to couple thereto.

Axle portions 136 may include body coupling structures 138 which may be configured to reversibly couple to a body portion (not shown). It will be appreciated that although body coupling structures are shown as being able to couple to a body portion via friction or interference fit, other configurations may be utilized, without straying from the concepts disclosed herein.

Axle portion 136 may further include wheel receivers 140 which may be configured to rotationally couple to wheel portions (not shown). It will be appreciated that since axle portions 136 may couple to frame portion 132 in many different configurations such that many axle portions 136 may couple to a body portion 132 as well as coupling to the body portion in many different positions, as desired. Axle portion 136 may also include tabs 142 which may facilitate coupling and decoupling of the body portions, wheel portions, and other portions of the system, as desired. Furthermore, tabs 142 may facilitate the telescoping action of axle portions 136 to accommodate for the use of different body portions and styles, as wall as different wheel configurations. This configuration may also facilitate altering the configuration of the system to adjust for different wind conditions.

System 130 may further include a sail adapter 152 which may be configured to couple and decouple to a sail in many different positions. Sail adapter 152 may extend into and/or otherwise couple to bolt 148 which may extend through orifice 134 of body portion 132 to couple to nut 150. Although a nut and bolt configuration has been shown, it will be appreciated that many other configurations and methods may be utilized to couple these items together, as desired.

System 130 may further include limitors 146 and stop 144 which may also couple to bolt 148. In this manner, the positions of limitors 146 may be varied to vary the travel of the sail as limited by stop 144. Stop 144 may also be threaded and screw onto bolt 148 however, other coupling methods and configurations may be utilized as desired.

System 130 may also include a sail receiver 154 which may be configured to receive the coupling configuration as described above. This may allow different positions for a sail to be coupled to the system as well as more than one sail being coupled to the system, as desired. This may further enhance the configurability of the system and may make the system more attractive to potential purchasers. Although a generally I-shaped configuration is shown, it will be appreciated that other simply vs simple configurations may be utilized with straying from the inventive concepts herein. Furthermore sail receiver 154 may be coupled at the ends of frame 132 to extend the frame 132 and to allow sails to be coupled to the system at those extensions.

This exemplary embodiment may include a dimensionally standardized chassis and universal configuration designed to accommodate a wide variety of vehicle configurations by allowing for alternate positions for axles, sail pivot points, plug in accessories, such as ballast, etc.

With this somewhat simple design, the system may be inexpensive, have very few parts, may be highly configurable, and may portions of the system may be utilized with other systems, as desired. These inexpensive and highly configurable configurations may make it more likely for a child or parent to purchase one or more systems.

Wheels for the system may be of varying width and height and may be coupled to varying numbers of axles. Axles may be located through various parts of the system. One or more sails may be coupled to the system in different arrangements and may have different pivot locations located throughout the system. Furthermore, bodies may be included with the system that may have side skirts, wheel wells and/or body pans, as desired. Yet further, a variety of add-ons and accessories may be included and/or sold separately to further enhance the configurability of the overall system.

Ballast and other accessories may be utilized with the system to change the characteristics thereof. Furthermore with this frame configuration, many different body portions 132 may be utilized by adjusting the frame and axle portions (undercarriage and chassis) thereof. Furthermore the axle portions 136 and wheel portions 140 may be extendable and may be made in different lengths and specifications such that many, many different wheels, bodies, sails, etc. may be utilized with the various systems.

Figure 7:
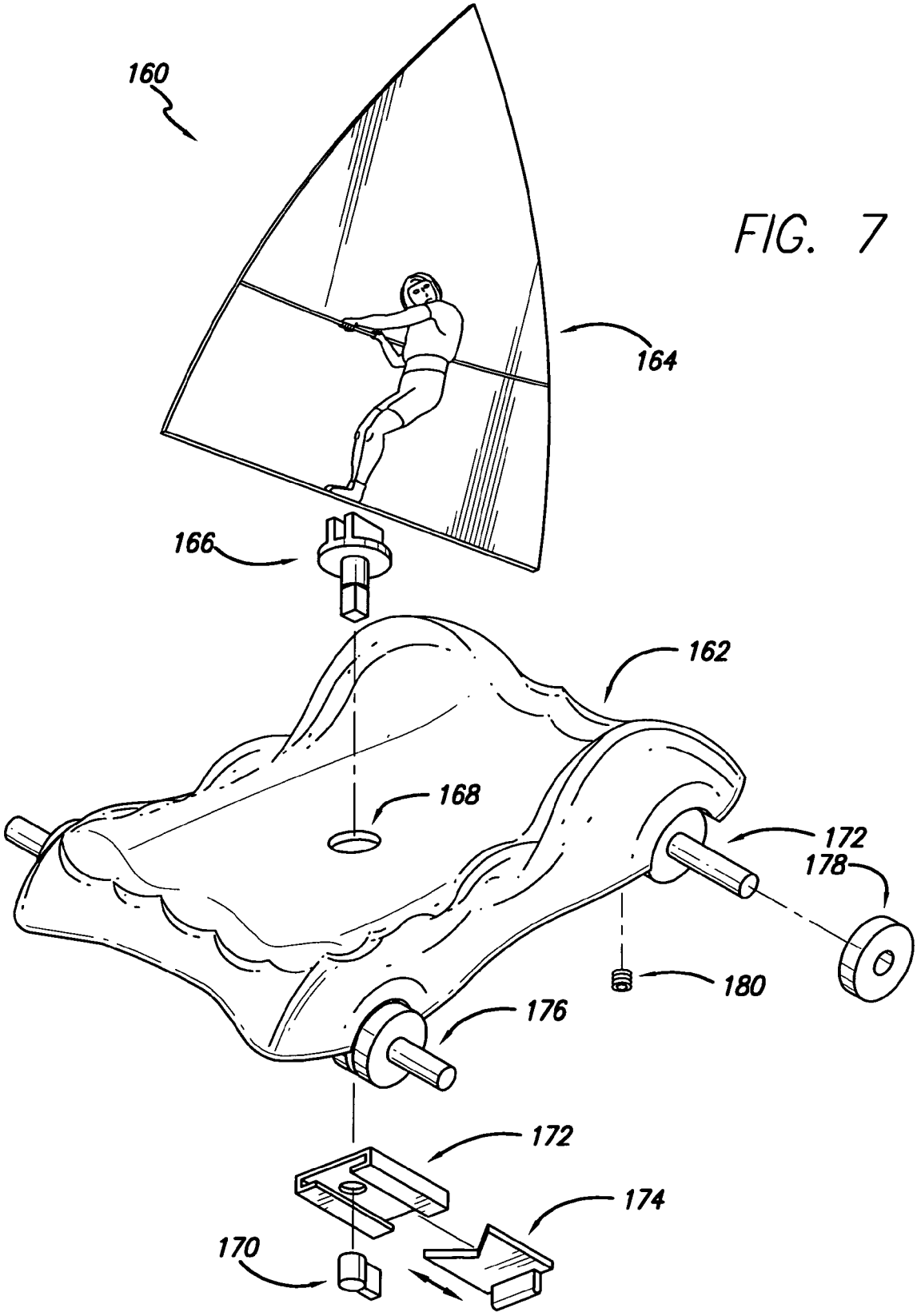
FIG. 7 is an exploded, perspective view of a vehicle system according to an exemplary embodiment.

FIG. 7 shows an exemplary embodiment of a vehicle system, generally at 160. System 160 may include a body portion 162 as well as a sail portion 164. Body portion 162 as shown, may be three-dimensional and in this embodiment, shown as waves. Furthermore, sail portion 164 may include graphics such as a wind surfer and/or other graphics such that it may appear that a wind surfer is surfing through water as the vehicle moves along a surface.

System 160 may further include a sail adapter 166 which may be configured to couple to sail 164 and configured to extend through orifice 168 within body portion 162. This configuration may rotatably couple sail 164 to body 162. Sail adapter 166 may be configured to couple to sail stop 170. Sail adapter 166 may also extend through limitor 172 as well as adjustable limitor 174 that may make the limiting of rotation of sail 164 with respect to body portion 162 variable. With this configuration, the travel of sail laterally may be limited by sail stop 170 and limitor 172 such that it may be adjusted for various conditions. This configuration may make the system more configurable for different wind and/or other force conditions.

System 160 may include an axle portion 176 which may be formed within and/or coupled to body portion 162, or other configurations as shown in the previous figures, or other configurations, as desired. System 160 may further include a locking portion 180 which may be configured to couple axle portion 176 to body portion 162.

In this embodiment axle portion 176 may be configured to be telescoping. This configuration may accommodate for the use of different body portions and styles, as wall as different wheel configurations. This configuration may also facilitate altering the configuration of the system to adjust for different wind conditions.

System 160 may further include a wheel portion 178 which may be configured to rotatably couple to axle portion 176 such that it would provide a configuration for the system to move on a support surface, utilizing very low forces such as a breeze, wind, and/or other forces, as desired.

As shown by the various embodiments of this invention, the system is very highly configurable which may appeal to many different users and/or buyers, including children and/or parents. Furthermore, the system may be made from very lightweight and inexpensive products making it inexpensive to manufacture and to sell and/or give away. Furthermore, the system may be configured to be easily assemblable by a user such that it may be assemblable by children.

Furthermore, as described by the exemplary embodiments, the system may include graphics and other accessories that may make it appealing to users, such as children. The systems may be formed relatively small such that they may be the size of trading cards to further make them attractive to children. In operation, the sail may move rapidly, in a self-adjusting manner. The additional movements of the sail and other accessories may cause the vehicle and/or other portions of the system to appear animated. Many different vehicles and toys may be configured and produced in this manner, with this configuration.

In exemplary embodiments disclosed herein, the vehicle may be designed to be very lightweight and low mass, being primarily made from low-density foam sheets, and yet they may be stable, self-adjusting, and may uniquely portray a wide variety of subjects, including, but not limited to, human, animal, or fanciful figures, and/or high-performance land and water vehicles, and the like. Moreover, the system may incorporate a relatively simple configuration to allow the sail to continuously adjust to the wind direction and forces for any particular downwind or crosswind path of vehicle travel. In exemplary embodiments, the configuration may take advantage of the switching, opposing wind directions to enhance the animated effect of rolling to and fro. Furthermore, this may be a learning toy such that a child or other user may learn about wind and other forces, sailing and vehicles. This may make the system more likely to be purchased by a parent for a child to facilitate the learning of the child.

In closing, it is to be understood that the exemplary embodiments described herein are illustrative of the principles of the present disclosure. Other modifications that may be employed are within the scope of this disclosure. Thus, by way of example, but not of limitation, alternative configurations may be utilized in accordance with the teachings herein. Accordingly, the drawing and description are illustrative and not meant to be a limitation thereof.

What is claimed is:

1. A wind propelled rolling vehicle system, comprising:

a sheet configured with a removable first shape, second shape and plurality of third shapes;

an adaptor configured to rotatably couple said first shape to said second shape and defining a first axis of rotation;

an axle portion configured to couple to said second shape and defining a second axis of rotation; and hub portions that form one or more flanged hubs configured to couple at least one of said third shapes to said axle portion, said hubs comprising a bearing surface oriented generally perpendicular to said second axis of rotation to maintain proper alignment of the at least one of said third shapes in relation to the second shape, and a bushing surface adjacent to said bearing surface and oriented generally parallel to said second axis of rotation to spread dynamic loads and maintain proper alignment of the at least one of said third shapes in relation to the axle portion for smooth rolling thereof;

wherein said shapes are configured in one unitary sheet of lightweight low-mass material, and are configured to relatively easily couple together to form a 3-dimensional rolling toy that is propelled by and stable in dynamic wind environments due at least in part to the combination of bearing and bushing surfaces of the hubs.

2. The system of claim 1, wherein said first shape comprises a sail portion.

3. The system of claim 2, wherein said sail portion is automatically self-adjusting with respect to a wind in dynamic wind environments due at least in part to the interaction between the sail portion and the second shape.

4. The system of claim 1, wherein said second shape comprises a body portion.

5. The system of claim 1, wherein said second shape comprises at least one bushing.

6. The system of claim 1, wherein at least one of said third shapes comprise a wheel.

7. The system of claim 1, wherein at least one of said third shapes comprises a bushing.

8. A method of constructing a 3-dimensional rolling vehicle from generally 2-dimensional parts, comprising:

providing a unitary sheet of lightweight low-mass material configured with a removable sail portion, body portion, and a plurality of wheel portions;

coupling an axle portion to said body portion, said axle portion defining a first axis of rotation;

providing an adaptor and hub portions that form one or more flanged hubs, said hubs comprising a bearing surface oriented generally perpendicular to said first axis of rotation to maintain proper alignment of the wheel portions in relation to the body portion, and a bushing surface adjacent to said bearing surface and oriented generally parallel to said first axis of rotation to spread dynamic loads and maintain proper alignment of the at least one of said third shapes in relation to the axle portion for smooth rolling thereof;

rotatably coupling said sail portion to said body portion via said adaptor; and coupling at least two of said wheels to said axle portion via said hubs thereby forming a 3-dimensional rolling vehicle that is propelled by dynamic wind environments, stable in such dynamic environments as a result of the combination of bearing and bushing surfaces of the hubs, and automatically self-adjusting in dynamic wind environments due to the interaction between the sail portion and the body portion.

9. A wind propelled rolling vehicle system, comprising:

a unitary sheet of lightweight low-mass material configured with a removable sail portion, body portion, and plurality of wheel portions;

an adaptor configured to couple said sail portion to said body portion;

an axle configured to rotatably couple to said body portion and defining a first axis of rotation; and hub portions that form one or more flanged hubs configured to couple at least one of said wheel portions to said axle said hubs comprising a bearing surface oriented generally perpendicular to said first axis of rotation to maintain proper alignment of the at least one of said wheel portions in relation to the body portion, and a bushing surface adjacent to said bearing surface and oriented generally parallel to said first axis of rotation to spread dynamic loads and maintain proper alignment of the at least one of said third shapes in relation to the axle portion for smooth rolling thereof;

wherein said shapes are configured in one unitary sheet, and are configured to relatively easily couple together to form a 3-dimensional rolling toy that is propelled by and stable in dynamic wind environments due to the combination of bearing and bushing surfaces of the hubs and is automatically self-adjusting in dynamic wind environments by the interaction between the sail portion and the body portion.

10. The system of claim 9, further comprising bushings configured to couple to said body portion and at least two of said wheel portions.

11. The system of claim 9, wherein said body portion comprises a slot or stops configured to receive or engage with said adaptor or other portion of said sail portion to define a predetermined range of rotation of said sail portion with respect to said body portion to insure that the sail portion is automatically self-adjusting in dynamic wind environments.

12. The system of claim 9, wherein said sail portion is self-adjusting with respect to a wind.

13. A wind propelled rolling vehicle system, comprising:

a unitary sheet of lightweight low-mass material configured with a removable sail portion, body portion, and plurality of wheel portions;

an adaptor configured to rotatably couple said sail portion to said body portion;

an axle means defining a first axis of rotation and configured to couple to said body portion and to said wheel portions; and hub portions that form one or more flanged hubs configured to couple at least one of said wheel portions to said axle means, said hubs comprising a bearing surface oriented generally perpendicular to said first axis of rotation to maintain proper alignment of the at least one of said wheel portions in relation to the body portion, and a bushing surface adjacent to said bearing surface and oriented generally parallel to said first axis of rotation to spread dynamic loads and maintain proper alignment of the at least one of said third shapes in relation to the axle portion for smooth rolling thereof;

wherein said portions are formed in one unitary sheet of lightweight low-mass material, and are configured to relatively easily couple together to form a 3-dimensional rolling toy that is propelled by and stable in dynamic wind environments as a result of the combination of bearing and bushing surfaces of the hubs and automatically self-adjusting with respect to a wind due to the interaction between the sail portion and the body portion.

14. The system of claim 13, wherein said body portion comprises a slot configured to receive said adaptor to limit the rotation of said sail with respect to said body portion.

15. The system of claim 13, wherein said sail portion is self-adjusting with respect to a wind.

* * * * *